US012495876B1

(12) United States Patent
Peng

(10) Patent No.: US 12,495,876 B1
(45) Date of Patent: Dec. 16, 2025

(54) PRESS-GRAB TYPE CARD BOX

(71) Applicant: Qiyong Peng, Yichun (CN)

(72) Inventor: Qiyong Peng, Yichun (CN)

( * ) Notice: Subject to any disclaimer, the term of this patent is extended or adjusted under 35 U.S.C. 154(b) by 0 days.

(21) Appl. No.: 18/918,759

(22) Filed: Oct. 17, 2024

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 190/147
See application file for complete search history.

(56) References Cited

U.S. PATENT DOCUMENTS 10,653,222 B2 * 5/2020 Scharnigg ..... B65D 83/08
11,344,091 B2 * 5/2022 Goodwin ..... A45C 11/182
2015/0335118 A1 * 11/2015 Van Geer ..... A45C 11/182 150/147
2020/0178657 A1 * 6/2020 Van Geer ..... A45C 11/182

* cited by examiner

*Primary Examiner* — Sue A Weaver

(57) ABSTRACT

A press-grab type card box includes an outer housing. An opening is defined in a top end of the outer housing. The outer housing is also provided with an accommodating cavity that is capable of accommodating an external card. The opening is in communication with the accommodating cavity, so that the external card can be pushed into the accommodating cavity from the opening. A pushing member is provided at a bottom portion of the accommodating cavity for holding at least one external card. A friction member is provided on an inner surface of the outer housing for preventing the external card from slipping off. The outer housing is also equipped with a triggering member. The triggering member abuts against the pushing member. The triggering member is configured for moving between a first position and a second position.

20 Claims, 10 Drawing Sheets

PRESS-GRAB TYPE CARD BOX

TECHNICAL FIELD

The present invention relates to the field of card boxes, particularly to a press-grab type card box.

BACKGROUND ART

In daily life, cards (such as ID cards, credit cards, bus cards, etc.) have become indispensable items for people. However, cards are prone to slipping out of the card holder or wallet during use, resulting in loss or damage. This not only brings inconvenience to users, but may also cause economic losses and personal information leakage. Therefore, how to effectively prevent cards from falling has become an urgent problem to be solved.

At present, there are various common card box designs on the market, but traditional card boxes usually adopt a simple plug-in design, where the cards are fixed in the card box only by friction and are easy to slide out during the process of taking and placing. In addition, although some card boxes have been added with lids or zippers, the cards may still fall off during frequent use and are not easily taken by users.

Therefore, it is necessary to provide a new card box which can not only allow the cards to be easily taken out, but also effectively prevent the cards from falling off easily.

SUMMARY

In order to overcome the shortcomings of the prior art, a press-grab type card box is provided in the present invention. The press-grab type card box can not only allow a card to be easily taken out, but also effectively prevent the card from falling off easily.

The technical solution adopted by the present invention to solve its technical problem is as follows.

A press-grab type card box is provided in the present invention, including an outer housing. An opening is defined in a top end of the outer housing, and the outer housing is also provided with an accommodating cavity that is capable of accommodating an external card. The opening is in communication with the accommodating cavity, so that the external card can be pushed into the accommodating cavity from the opening. A pushing member is provided at a bottom portion of the accommodating cavity for holding at least one external card. A friction member is provided on an inner surface of the outer housing for preventing the external card from slipping off. The outer housing is also equipped with a triggering member. The triggering member abuts against the pushing member. The triggering member is configured for moving between a first position and a second position. When the triggering member is in the first position, the external card is held in the accommodating cavity. When the triggering member is in the second position, the triggering member is capable of driving the pushing member to push the external card at least partially out of the accommodating cavity.

As an improvement of the present invention, the outer housing includes a first housing and a second housing detachably connected to the first housing. A first outer side wall, a second outer side wall, and a bottom wall are provided between the first housing and the second housing. The second outer side wall is opposite to the first outer side wall. The bottom wall is positioned between the first outer side wall and the second outer side wall. An installation hole is defined in the first outer side wall, and the triggering member is movably installed in the installation hole.

As an improvement of the present invention, the triggering member includes a first end and a second end. The first end is rotationally connected to an inner portion of the outer housing through a rotating member. The second end includes a transmission part. The transmission part abuts against the pushing member. When the triggering member is pressed, and the triggering member rotates around the rotating member, so that the transmission part drives the pushing member to move upward to push the external card out of the card box.

As an improvement of the present invention, the card box is also internally equipped with an elastic member for restoring the pushing member. The elastic member is obliquely disposed below the pushing member. One end of the elastic member is fixedly connected to the pushing member, and an opposite end of the elastic member is fixedly connected to an inner wall surface of the outer housing. When the trigger member is released, the elastic member drives the pushing member to move downward to restore the pushing member.

As an improvement of the present invention, a bottom portion of the outer housing is provided with an installation slot. The installation slot is positioned below the pushing member. The installation slot is equipped with an inclined surface on one side adjacent to the elastic member. The inclined surface has an identical inclination angle with the elastic member. The inclined surface is used for reducing friction and resistance during a process of the elastic member driving the pushing member to be restored.

As an improvement of the present invention, a through hole is defined in the pushing member, and a fixing shaft is provided on the inner wall surface of the outer housing. One end of the elastic member is installed in the through hole, and an opposite end of the elastic member is fixedly connected to the fixing shaft.

As an improvement of the present invention, the inner portion of the outer housing is provided with a concave platform on one side near the first outer side wall. A fixing hole is defined in the concave platform. The first end is provided with a connecting part. A connecting hole is defined in the connecting part. The rotating member passes through the connecting hole and extends to the fixing hole for fixation, so that the first end is capable of rotating around the rotating member.

As an improvement of the present invention, a first position limiting block extends from a bottom edge of the concave platform, and a second position limiting block is also provided on one side of the inner portion of the outer housing near the first outer side wall. The first position limiting block and the second position limiting block jointly define a moving slot. The moving slot is configured for allowing the triggering member to move within the moving slot.

As an improvement of the present invention, an installation column is provided between the first position limiting block and the second position limiting block, and the friction member is installed on the installation column to prevent the external card from falling into the card box again when pushed out of the card box.

As an improvement of the present invention, the friction member is configured as a silicone block, and one side of the friction member near the inner portion of the outer housing is also provided with a plurality of friction protrusions for preventing the external card from falling into the card box again when pushed out of the card box.

As an improvement of the present invention, the friction member is configured as a cotton cloth, and a surface of the cotton cloth is provided with a raised transverse bar. The raised transverse bar is used for providing a greater friction force. The friction member is bonded to the inner wall surface of the outer housing, and a coverage area of the friction member is not less than 0.9% of an surface area of the inner wall surface of the outer housing.

As an improvement of the present invention, a receiving part is provided at a junction of the first outer side wall and the bottom wall. The receiving part is provided with a receiving slot for receiving the transmission part. The receiving slot is in communication with the installation hole, so that the transmission part can pass through the installation hole and be movably installed in the receiving slot.

As an improvement of the present invention, a bottom portion of the transmission part is provided with a buckle. The buckle abuts against the receiving part, so that when the triggering member moves to the first position, the transmission part is positioned at the inner portion of the outer housing.

As an improvement of the present invention, the pushing member is transversely installed at the bottom portion of the outer housing. The pushing member is configured as a metal pushing member. One end of the pushing member is rotationally connected to the inner wall surface of the outer housing, and an opposite end of the pushing member is provided with a plurality of steps. The steps are used for placing cards inside the accommodating cavity in a staggered manner.

As an improvement of the present invention, the pushing member includes a rotating end and a movable end. The rotating end is provided with a rotating hole, and the inner wall surface of the outer housing is provided with a shaft column. The shaft column is inserted into the rotating hole, so that the pushing member is capable of rotating around the shaft column. When the triggering member moves to the second position, the transmission part is capable of driving the pushing member to rotate around the shaft column, so that the opposite end of the pushing member moves upward to push the external card at least partially out of the card box.

As an improvement of the present invention, the steps are positioned at the movable end and are oriented towards an inner wall surface of the second housing. Heights of the steps increase sequentially in a direction from the movable end towards the rotating end. Each of the steps is configured for receiving one external card.

As an improvement of the present invention, the outer housing is also equipped with a fixing clamp for fixing the card box to objects such as belts or straps. The fixing clamp includes a connecting wall and a clamping wall integrally formed with the connecting wall. The connecting wall is detachably installed on the bottom wall, and the clamping wall is used for clamping the card box to an external device.

As an improvement of the present invention, the clamping wall includes an abutting plate obliquely arranged from outside to inside and a warping plate arranged from inside to outside. The warping plate is arranged at an end of the abutting plate, and a connection between the warping plate and the abutting plate abuts against an outer surface of the first housing, so that the card box is clamped with objects such as belts or straps.

As an improvement of the present invention, the card box further includes a protective cover. The protective cover includes a first part and a second part. The second part is capable of rotating relative to the first part, and the first part is fixedly connected to an outer surface of the second housing. The second part is capable of being folded and overlaid on the outer surface of the first housing.

As an improvement of the present invention, a magnetic attraction member is provided in the installation slot, and a magnetic attraction part is provided on the second part. The magnetic attraction member is capable of magnetically attracting with the magnetic attraction part, so that the second part is always overlaid on the outer surface of the first housing.

Beneficial effects of the present invention are as follows. The press-grab type card box is provided in the present invention, including the outer housing. The opening is defined in the top end of the outer housing. The outer housing is also provided with the accommodating cavity that is capable of accommodating the external card. The opening is in communication with the accommodating cavity, so that the external card can be pushed into the accommodating cavity from the opening. A pushing member is provided at the bottom portion of the accommodating cavity for holding at least one external card. A friction member is provided on an inner surface of the outer housing for preventing the external card from slipping off. The outer housing is also equipped with the triggering member. The triggering member abuts against the pushing member. The triggering member is configured for moving between the first position and the second position. When the triggering member is in the first position, the external card is held in the accommodating cavity. When the triggering member is in the second position, the triggering member is capable of driving the pushing member to push the external card at least partially out of the accommodating cavity. This card box not only allows the card to be easily taken out, but also effectively prevents the card from falling off easily.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

Figure 1:
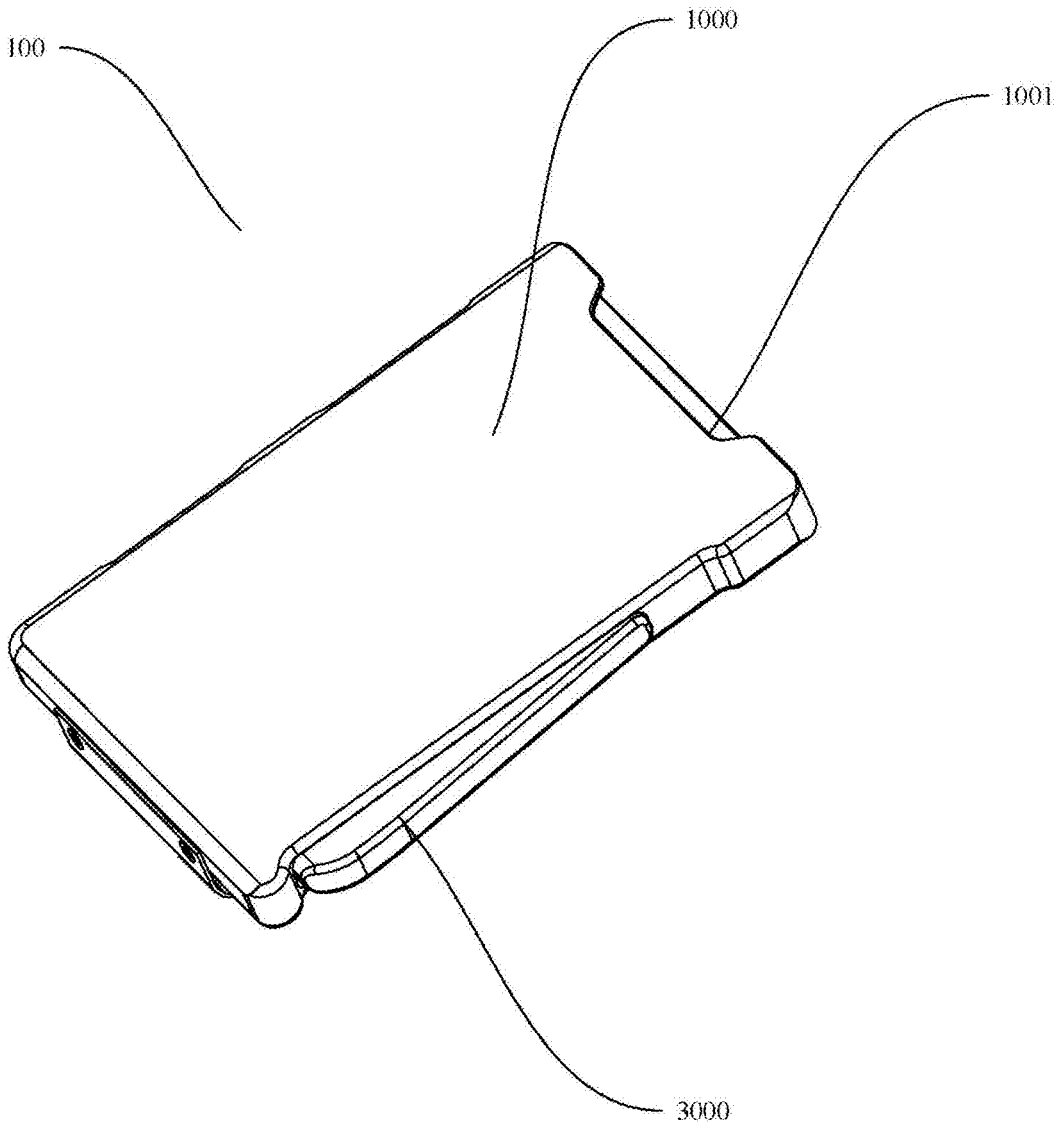
FIG. 1 is a schematic diagram of an overall structure of the present invention.

REFERENCE NUMERALS card box 100;

outer housing 1000; opening 1001; accommodating cavity 1002; friction member 1003; first housing 1004; second housing 1005; first outer side wall 1006; installation hole 1101; fixing shaft 1102; concave platform 1103; fixing hole 1104; first position limiting block 1105; second position limiting block 1106; moving slot 1107; installation column 1108; second outer side wall 1007; bottom wall 1008; friction protrusion 1009; receiving part 1201; receiving slot 1202; shaft column 1203; installation slot 1204; magnetic attraction member 1205; inclined surface 1206;

pushing member 2000; through hole 2001; elastic member 2002; step 2003; rotating end 2004; movable end 2005; rotating hole 2006;

triggering member 3000; first end 3001; connecting part 3101; connecting hole 3102; second end 3002; transmission part 3201; buckle 3202; rotating member 3003;

fixing clamp 4000; connecting wall 4001; clamping wall 4002; abutting plate 4003; warping plate 4004;

protective cover 5000; first part 5001; second part 5002; magnetic attraction part 5003.

DETAILED DESCRIPTION OF THE EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
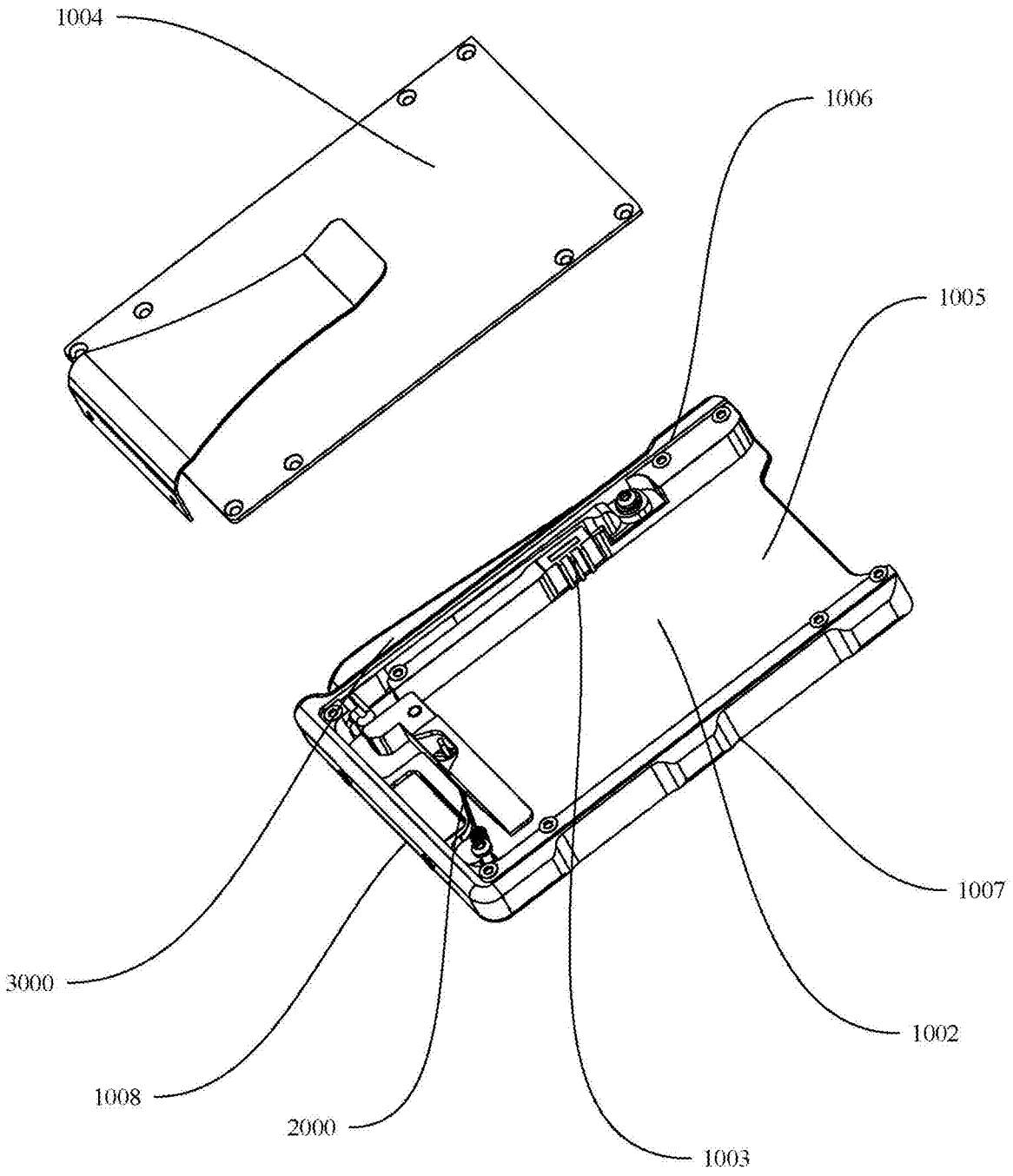
FIG. 2 is a schematic diagram of an exploded structure of the present invention.

A press-grab type card box is disclosed in the present invention, as shown in FIGS. 1-2, including an outer housing 1000. An opening 1001 is defined in a top end of the outer housing 1000. The outer housing 1000 is also provided with an accommodating cavity 1002 that is capable of accommodating an external card. The opening 1001 is in communication with the accommodating cavity 1002, so that the external card can be pushed into the accommodating cavity 1002 from the opening 1001. A pushing member 2000 is provided at a bottom portion of the accommodating cavity 1002 for holding at least one external card. A friction member 1003 is provided on an inner surface of the outer housing 1000 for preventing the external card from slipping off. The outer housing 1000 is also equipped with a triggering member 3000. The triggering member 3000 abuts against the pushing member 2000. The triggering member 3000 is configured for moving between a first position and a second position. When the triggering member 3000 is in the first position, the external card is held in the accommodating cavity 1002. When the triggering member 3000 is in the second position, the triggering member 3000 is capable of driving the pushing member 2000 to push the external card at least partially out of the accommodating cavity 1002. Through the design of the pushing member 2000 and the triggering member 3000, a user can easily push the card out of the accommodating cavity 1002. Moreover, the friction member 1003 is provide on the inner surface of the outer housing 1000, which can effectively prevent the external card slipping in the accommodating cavity 1002 and ensure that the card remains stable when not in use.

Figure 3:
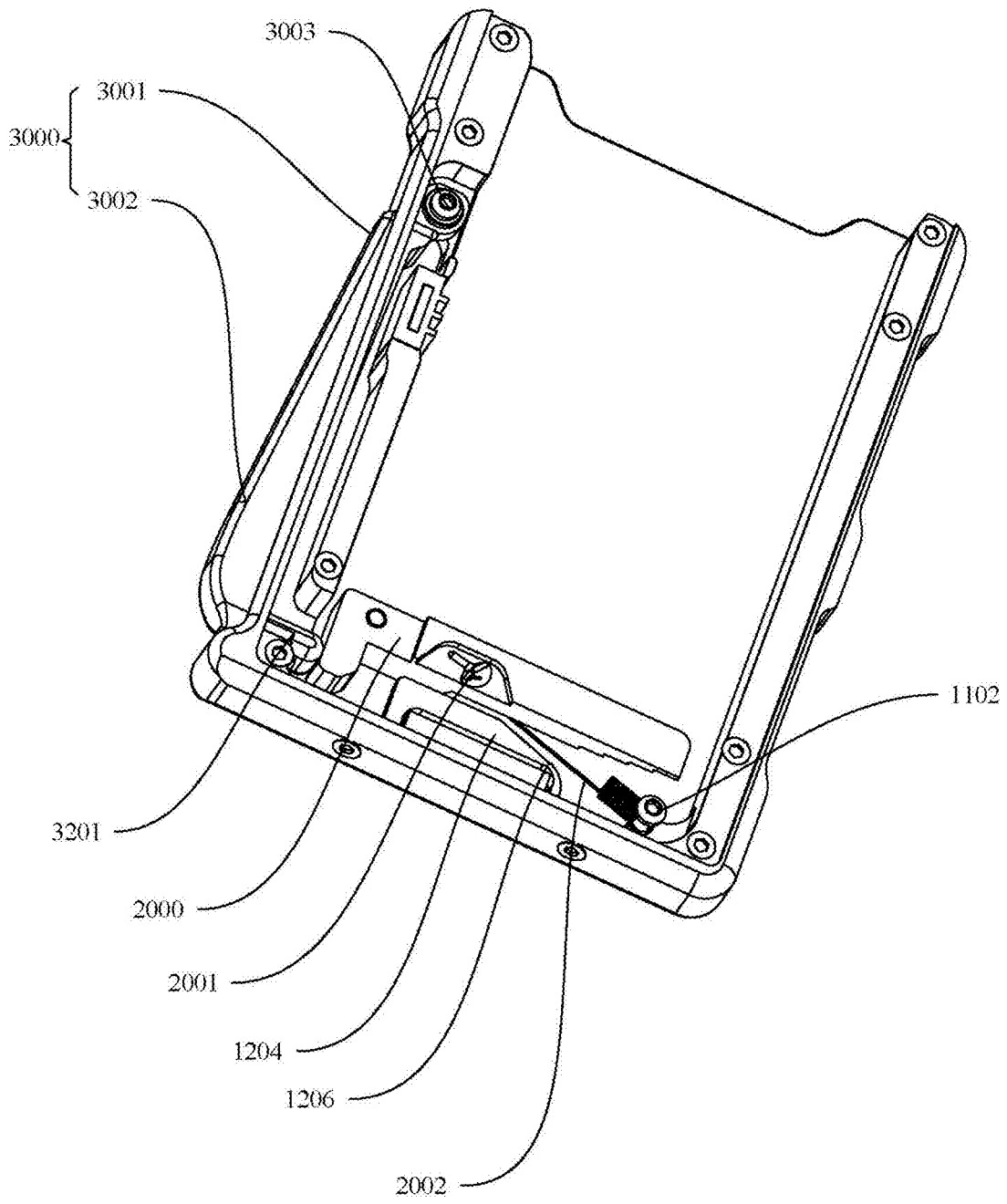
FIG. 3 is a schematic diagram of a structure of a triggering member, a pushing member, and an elastic member in the present invention.
Figure 4:
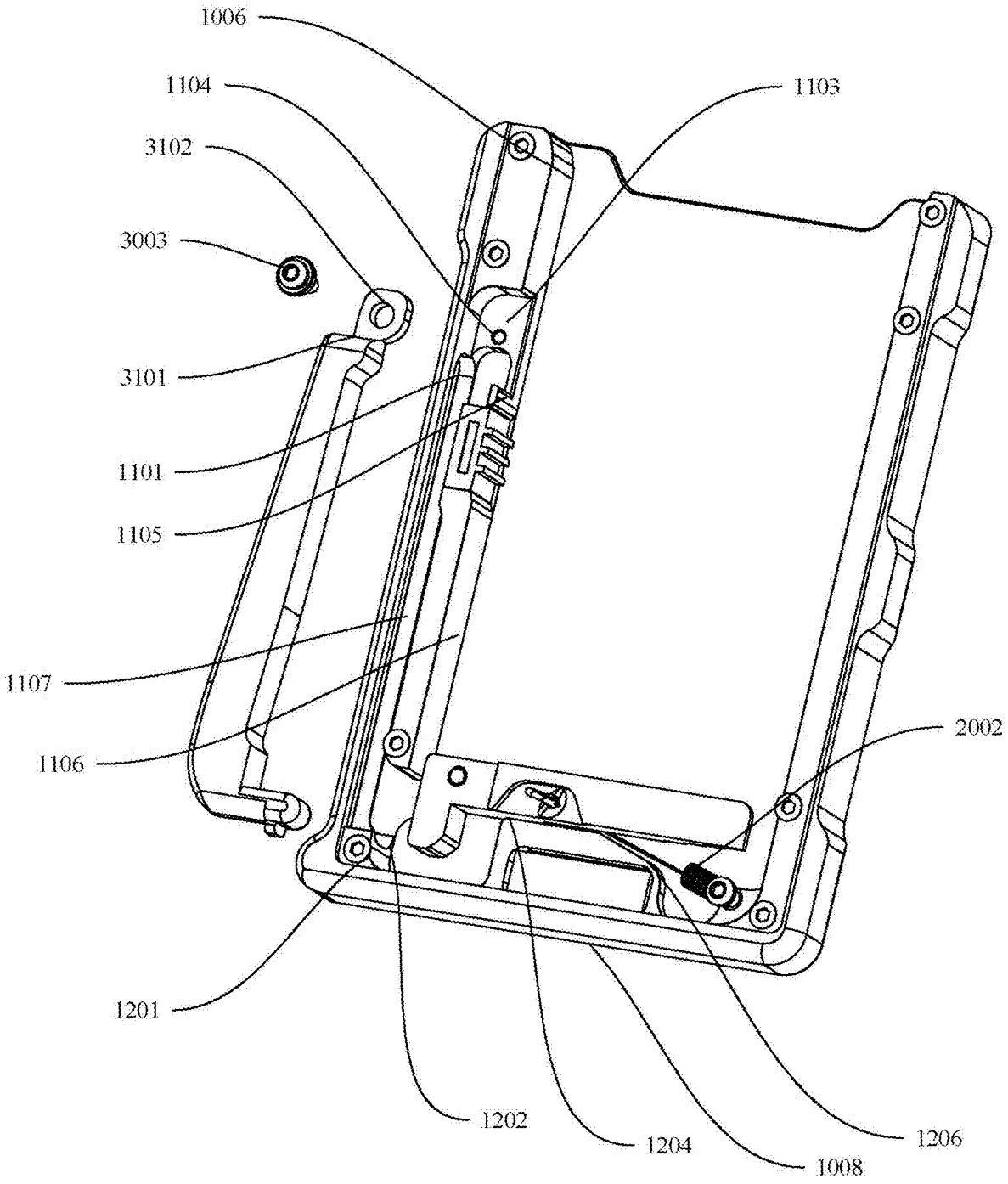
FIG. 4 is a schematic diagram of an installation structure of a triggering member.

In this embodiment, as shown in FIG. 3 and FIG. 4, the outer housing 1000 includes a first housing 1004 and a second housing 1005 detachably connected to the first housing 1004. A first outer side wall 1006, a second outer side wall 1007, and a bottom wall 1008 are provided between the first housing 1004 and the second housing 1005. The second outer side wall 1007 is opposite to the first outer side wall 1006. The bottom wall 1008 is positioned between the first outer side wall 1006 and the second outer side wall 1007. An installation hole 1101 is defined in the first outer side wall 1006, and the triggering member 3000 is movably installed in the installation hole 1101. The outer housing 1000 includes the first housing 1004 and the second housing 1005. The first housing 1004 and the second housing 1005 are detachably connected, making it convenient for the user to disassemble the outer housing for maintenance or replacement of internal components. The triggering member 3000 is movably installed in the hole, making the installation and adjustment of the triggering member 3000 more convenient, and improving the user's operating experience.

In this embodiment, as shown in FIG. 2, the triggering member 3000 includes a first end 3001 and a second end 3002. The first end 3001 is rotationally connected to an inner portion of the outer housing 1000 through a rotating member 3003. The second end 3002 includes a transmission part 3201. The transmission part 3201 abuts against the pushing member 2000. When the triggering member 3000 is pressed, the triggering member 3000 rotates around the rotating member 3003, so that the transmission part 3201 drives the pushing member 2000 to move upward to push the external card out of the card box 100. When the triggering member 3000 is pressed, the triggering member 3000 is capable of rotating around the rotating member 3003, causing the transmission part 3201 to drive the pushing member 2000 to move upward. This design allows the user to push out the card with a simple press, which is very convenient to operate. The transmission part 3201 abuts against the pushing member 2000, ensuring the stable movement of the pushing member 2000 and thus improving the reliability of the entire device.

In this embodiment, as shown in FIG. 3, the card box 100 is also internally equipped with an elastic member 2002 for restoring the pushing member 2000. The elastic member 2002 is obliquely disposed below the pushing member 2000. One end of the elastic member 2002 is fixedly connected to the pushing member 2000, and an opposite end of the elastic member 2002 is fixedly connected to an inner wall surface of the outer housing 1000. When the trigger member 3000 is released, the elastic member 2002 drives the pushing member 2000 to move downward to restore the pushing member. The elastic member 2002 can allow the pushing member 2000 to be automatically restored, reducing the user's operation steps and improving the convenience of use. In addition, the elastic member 2002 can effectively reduce the wear of mechanical components, improving the durability and service life of the device.

Figure 8:
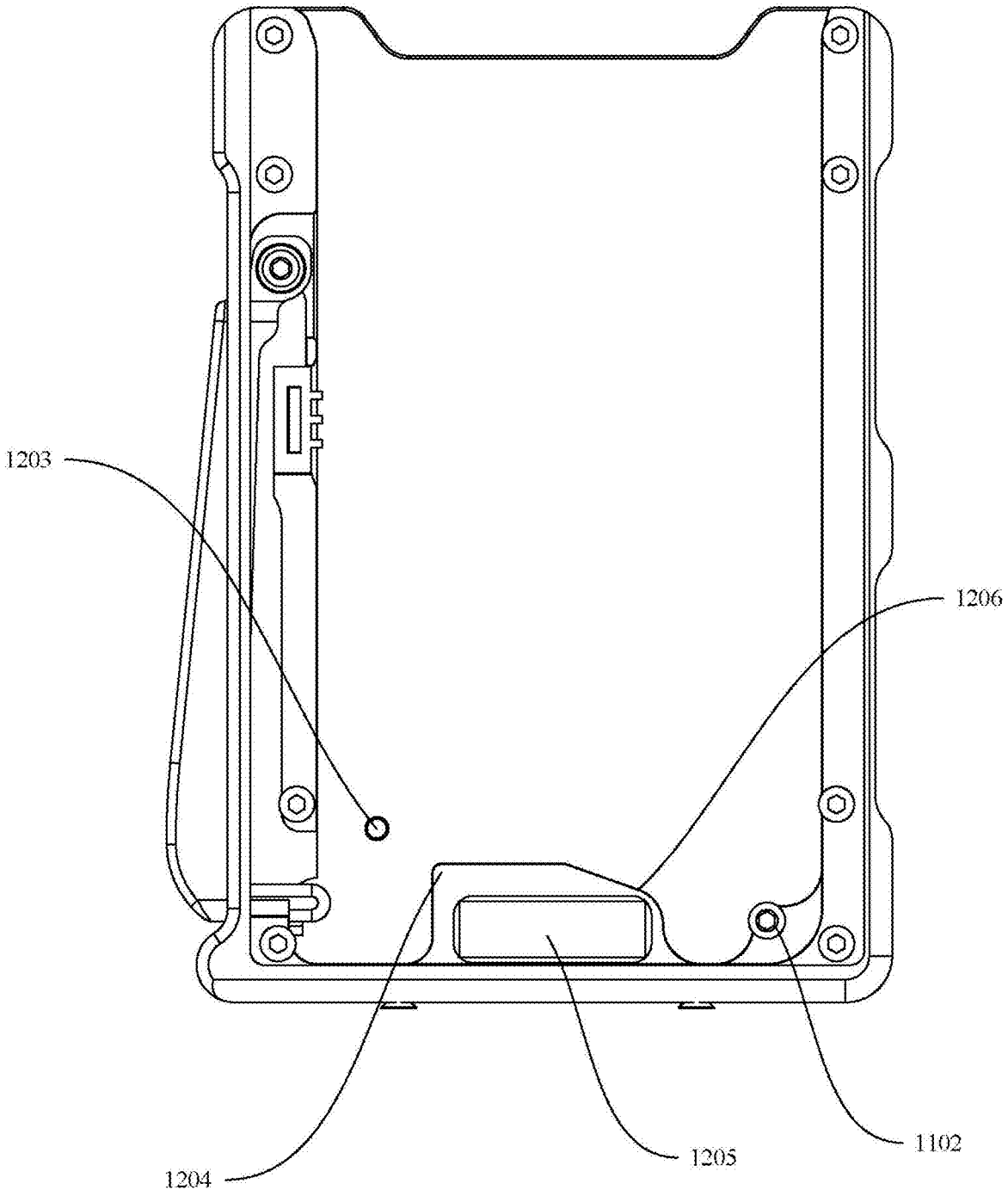
FIG. 8 is a schematic diagram of an internal structure of an outer housing.

In this embodiment, as shown in FIG. 3 and FIG. 8, a bottom portion of the outer housing 1000 is provided with an installation slot 1204. The installation slot 1204 is positioned below the pushing member 2000. The installation slot 1204 is equipped with an inclined surface 1206 on one side adjacent to the elastic member 2002. The inclined surface 1206 has an identical inclination angle with the elastic member 2002. The inclined surface 1206 is used for reducing friction and resistance during a process of the elastic member 2002 driving the pushing member 2000 to be restored. The inclined surface 1206 can effectively reduce the friction during the process of the elastic member 2002 driving the pushing member 2000 to be restored, so that the pushing member 2000 can be restored more smoothly, and the working efficiency of the device is improved.

In this embodiment, as shown in FIG. 3, a through hole 2001 is defined in the pushing member 2000, and a fixing shaft 1102 is provided on the inner wall surface of the outer housing 1000. One end of the elastic member 2002 is installed in the through hole 2001, and an opposite end of the elastic member 2002 is fixedly connected to the fixing shaft 1102. This design can effectively increase the stability of the connection of the elastic member 2002, preventing the elastic member 2002 from shifting or loosening during operation.

In this embodiment, as shown in FIG. 4, the inner portion of the outer housing 1000 is provided with a concave platform 1103 on one side near the first outer side wall 1006. A fixing hole 1104 is defined in the concave platform 1103. The first end 3001 is provided with a connecting part 3101. A connecting hole 3102 is defined in the connecting part 3101. The rotating member 3003 passes through the connecting hole 3102 and extends to the fixing hole 1104 for fixation, so that the first end 3001 is fixedly connected to the outer housing 1000 and is capable of rotating around the rotating member 3003. In this embodiment, it is preferred that the rotating member 3003 is a bolt, the triggering member 3000 is rotationally connected to the outer housing 1000 through the bolt, making the installation method of the triggering member 3000 and the outer housing 1000 more convenient, and providing greater flexibility and operational convenience.

In this embodiment, as shown in FIG. 4, a first position limiting block 1105 extends from a bottom edge of the concave platform 1103, and a second position limiting block 1106 is also provided on one side of the inner portion of the outer housing 1000 near the first outer side wall 1006. The first position limiting block 1105 and the second position limiting block 1106 jointly define a moving slot 1107. The moving slot 1107 is configured for allowing the triggering member 3000 to move within the moving slot 1107. By providing the moving slot 1107, the triggering member 3000 can only move within a range allowed by the moving slot 1107, which can effectively prevent the triggering member 3000 from deviating from a preset path, reduce the failure of the use of the card box 100, and improve the reliability of the use of the card box 100.

In other embodiments, a spring is provided in the moving slot 1107. The spring can allow the triggering member 3000 to be automatically restored when the triggering member 3000 moves in the moving slot 1107, improving a response speed and reliability of the card box 100.

Figure 5:
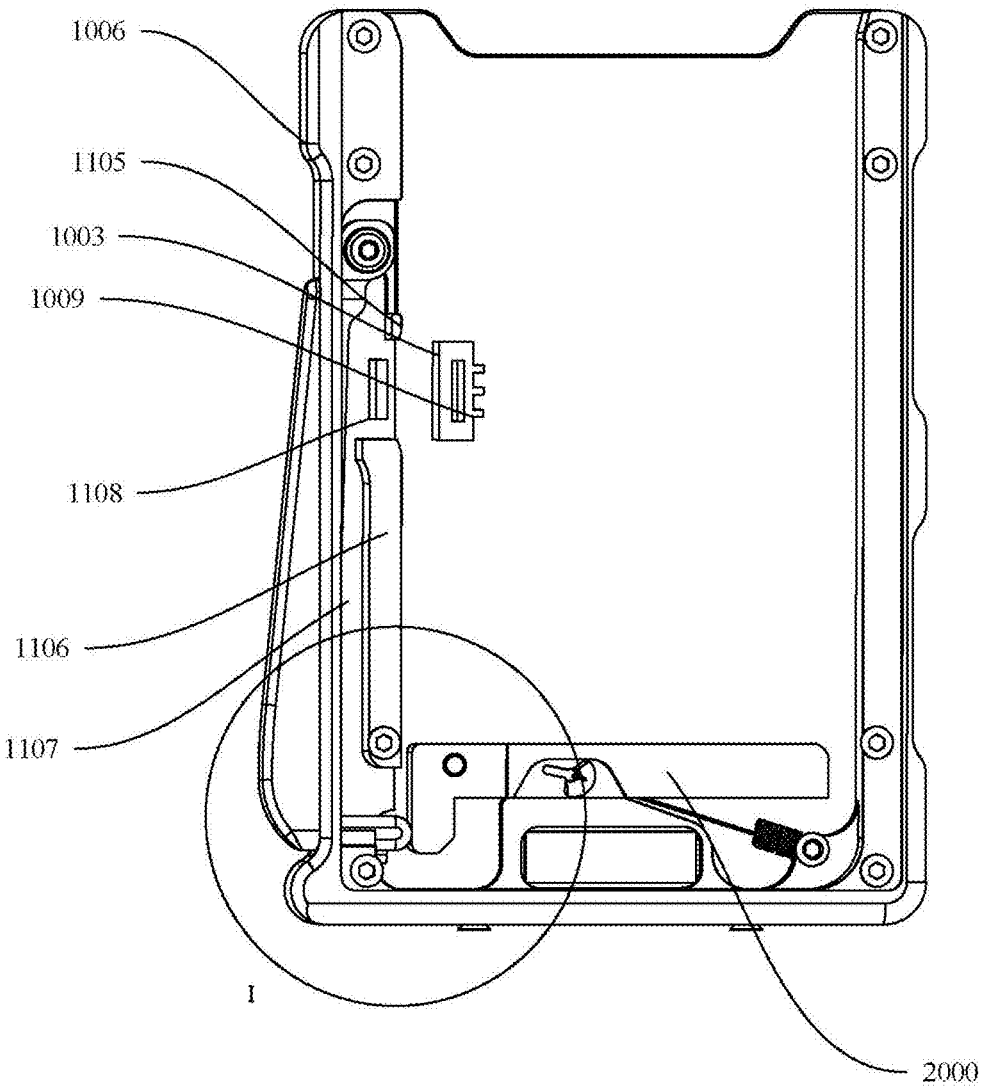
FIG. 5 is a schematic diagram of an exploded installation structure of a friction member.

In this embodiment, as shown in FIG. 5, an installation column 1108 is provided between the first position limiting block 1105 and the second position limiting block 1106, and the friction member 1003 is installed on the installation column 1108 to prevent the external card from falling into the card box 100 again when pushed out of the card box 100. The installation column 1108 and the friction member 1003 can effectively increase the stability of the external card during the process of pushing out, reducing the problem of the external card getting stuck or falling off due to sliding or tilting.

As a preferred embodiment of the present invention, the friction member 1003 can be configured as a silicone block, and one side of the friction member 1003 near the inner portion of the outer housing 1000 is also provided with a plurality of friction protrusions 1009 for preventing the external card from falling into the card box 100 again when pushed out of the card box 100. Silicone material has a high coefficient of friction, which can effectively increase the friction force when the card is pushed out, preventing the card from slipping. In addition, the friction protrusion 1009 can further increase a contact area and friction force between the card and the friction member 1003, thereby more effectively preventing the card from falling into the card box 100 again when pushed out.

As another preferred embodiment of the present invention, the friction member 1003 is configured as a cotton cloth, and a surface of the cotton cloth is also provided with a raised transverse bar. The raised transverse bar can provide a greater friction force. The friction member 1003 is bonded to the inner wall surface of the outer housing 1000 with adhesive to prevent the external card from falling into the card box 100 again when pushed out of the card box 100, and a coverage area of the friction member 1003 is not less than 0.9% of an surface area of the inner wall surface of the outer housing 1000.

In addition, the friction member 1003 in this embodiment can also be fixed to the inner wall surface of the outer housing 1000 using screws, or directly clamped onto the inner wall surface of the outer housing 1000. Cotton cloth is used as the friction member, and the cotton cloth material is soft, so that a surface of the card can be effectively protect from scratches or damage. The cotton cloth has a certain friction force, which can provide sufficient resistance when the card is pushed out, preventing the card from slipping or falling back into the card box 100. In addition, using cotton cloth as the friction member 1003 of the present invention can effectively reduce the production cost of the card box 100.

It should be noted that in addition to the friction member 1003 being configured as silicone block and cotton cloth as mentioned above, velvet, metal elastic sheets, plastic sheets, etc. can also be used as the friction member in this embodiment. All such materials can provide a large frictional force and protect the surface of the card from scratches.

Figure 6:
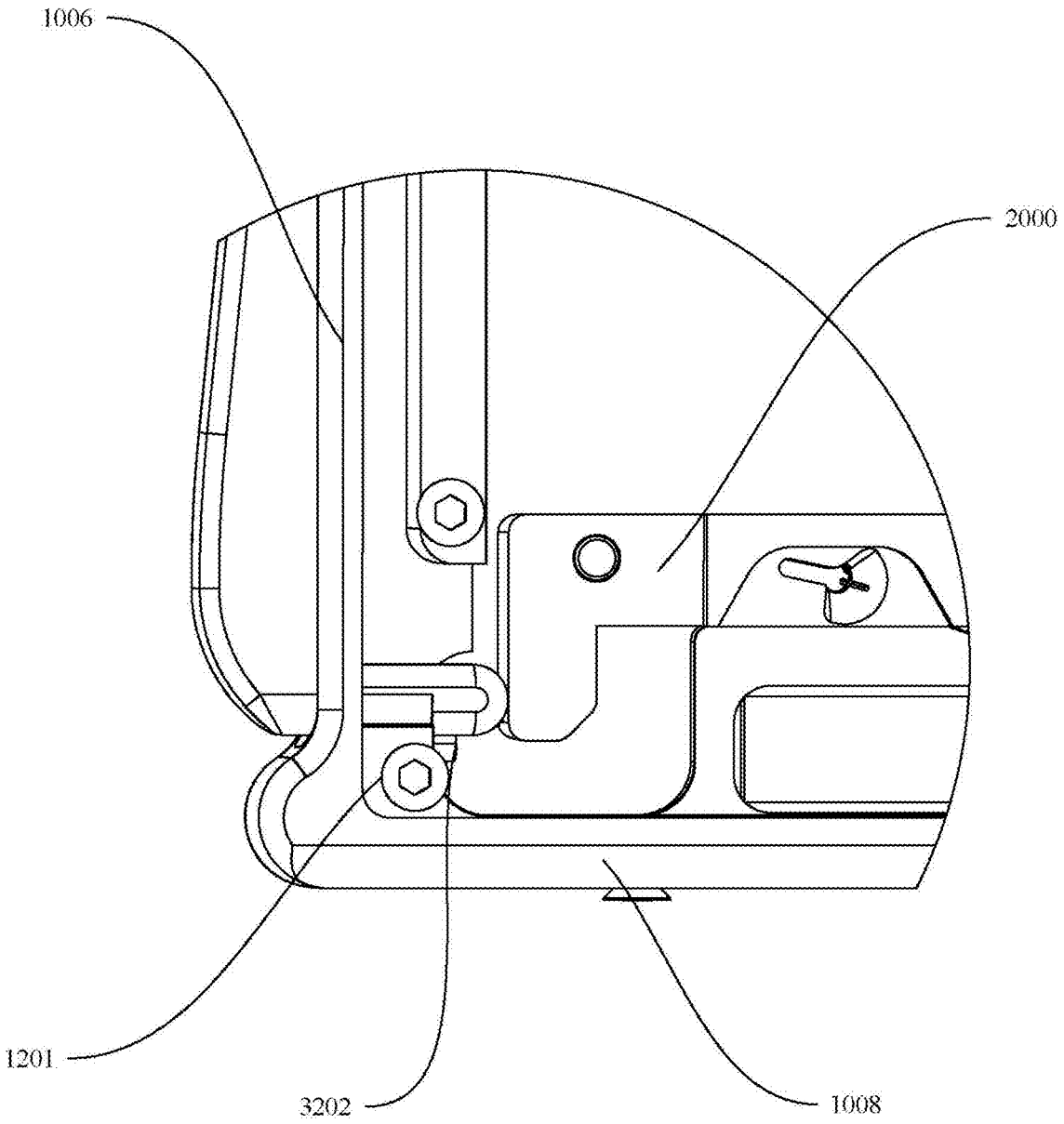
FIG. 6 is a schematic diagram of an enlarged structure at area I in FIG. 5.

In this embodiment, as shown in FIG. 6, a receiving part 1201 is provided at a junction of the first outer side wall 1006 and the bottom wall 1008. The receiving part 1201 is provided with a receiving slot 1202 for receiving the transmission part 3201. The receiving slot 1202 is in communication with the installation hole 1101, so that the transmission part 3201 can pass through the installation hole 1101 and be movably installed in the receiving slot 1202. The receiving slot 1202 is in communication with the installation hole 1101, allowing the transmission part 3201 to move stably inside the receiving slot 1202, reducing the possible problems of shaking or detachment of the transmission part 3201 during operation, thereby improving the overall stability and reliability of the card box 100.

In other embodiments, a buffer device is arranged inside the receiving slot 1202. By arranging the buffer device, an impact force of the transmission part 3201 during movement can be reduced, and the structural integrity of the transmission part 3201 and the receiving part 1201 can be protected.

In this embodiment, as shown in FIG. 6, a bottom portion of the transmission part 3201 is provided with a buckle 3202. The buckle 3202 abuts against the receiving part 1201, so that when the triggering member 3000 moves to the first position, the transmission part 3201 is positioned at the inner portion of the outer housing 1000. The buckle 3202 abuts against the receiving part 1201, which enables the transmission part 3201 to be stably positioned inside the outer housing 1000, reducing the possible problems of shaking or loosening of the transmission part 3201 during operation, thereby improving the reliability of the device.

In this embodiment, the pushing member 2000 is transversely installed at the bottom portion of the outer housing 1000. One end of the pushing member 2000 is rotationally connected to the inner wall surface of the outer housing 1000, and an opposite end of the pushing member 2000 is provided with a plurality of steps 2003 for placing cards inside the accommodating cavity 1002 in a staggered manner. One end of the pushing member 2000 is rotationally connected to the inner wall surface of the outer housing 1000, allowing the pushing member 2000 to flexibly perform pushing operations and adapt to different usage needs. The steps 2003 can effectively receive and fix external cards, providing compatibility and fixing methods for a variety of cards.

Figure 7:
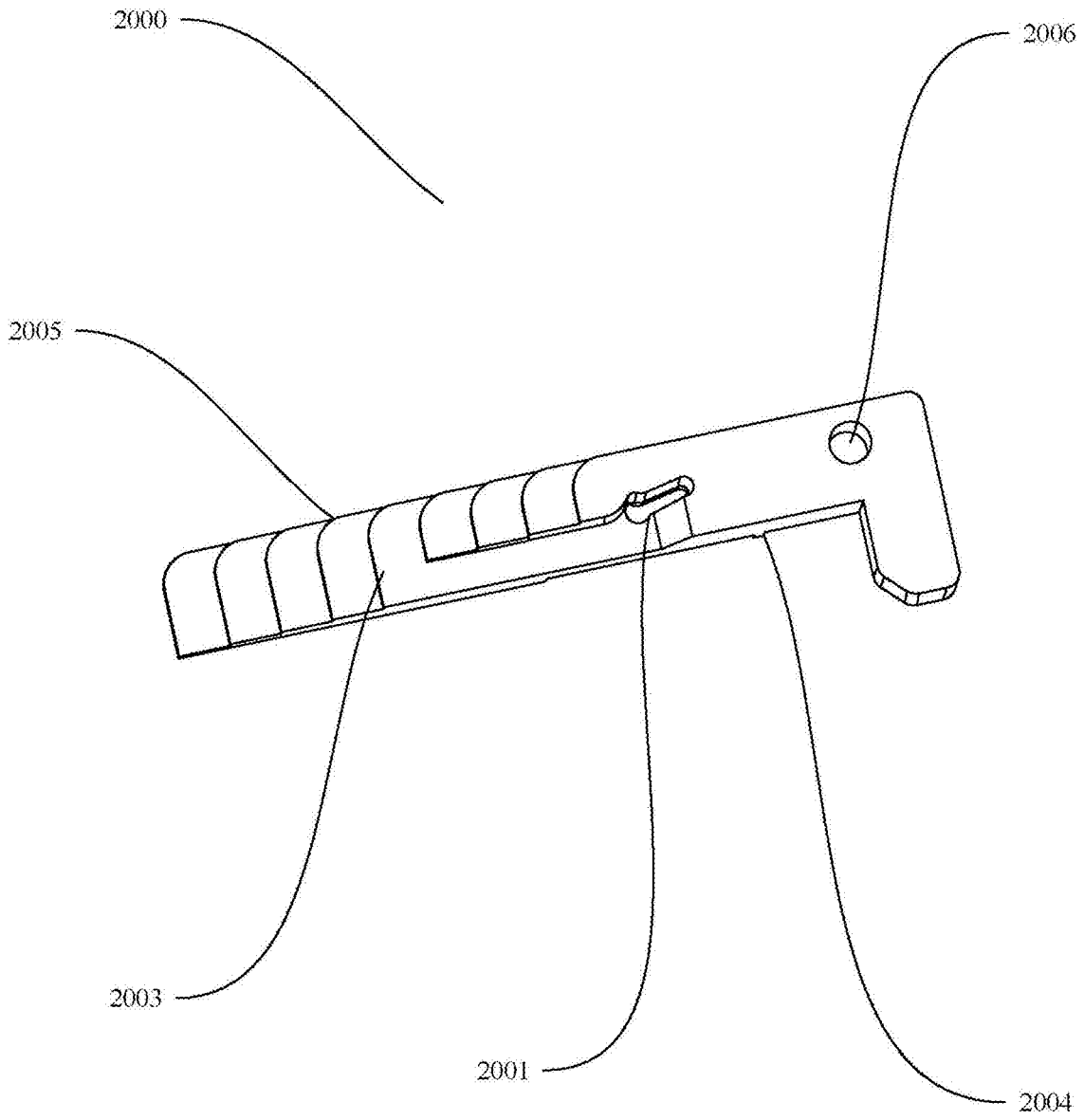
FIG. 7 is a schematic diagram of a structure of a pushing member.

Specifically, referring to FIG. 6 and FIG. 7, the pushing member 2000 includes a rotating end 2004 and a movable end 2005. The rotating end 2004 is provided with a rotating hole 2006, and the inner wall surface of the outer housing 1000 is provided with a shaft column 1203. The shaft column 1203 is inserted into the rotating hole 2006, so that the pushing member 2000 is capable of rotating around the shaft column 1203. When the triggering member 3000 moves to the second position, the transmission part 3201 is capable of driving the pushing member 2000 to rotate around the shaft column 1203, so that the opposite end of the pushing member 2000 moves upward to push the external card at least partially out of the card box. Through the cooperation of the rotating hole 2006 and the shaft column 1203, the pushing member 2000 can flexibly rotate around the shaft column 1203, improving the convenience of the device.

In this embodiment, referring to FIG. 6 and FIG. 7, the steps 2003 are positioned at the movable end 2005 and are oriented towards an inner wall surface of the second housing 1005. Heights of the steps 2003 increase sequentially in a direction from the movable end 2005 towards the rotating end 2004. Each of the steps 2003 is configured for receiving one external card. The user can press the triggering member 3000, so that the transmission part 3201 drives the rotating end 2004 of the pushing member 2000 to rotate around the shaft column 1203. At this time, the movable end 2005 applies a pushing force greater than an elastic restoring force generated when the elastic member 2002 is compressed, so as to push the card out of the accommodating cavity 1002 towards a direction of the opening 1001. The plurality of steps 2003 of different heights can push the cards positioned at various height positions in the accommodating cavity 1002. Positions of contact points between the steps 2003 of different heights and the cards are not on an identical axis, so that when the cards are pushed out from the accommodating cavity 1002, the plurality of cards are pushed out at different distances, so that the plurality of cards are staggered with each other, making it easy for the user to accurately and quickly take the desired card.

Figure 9:
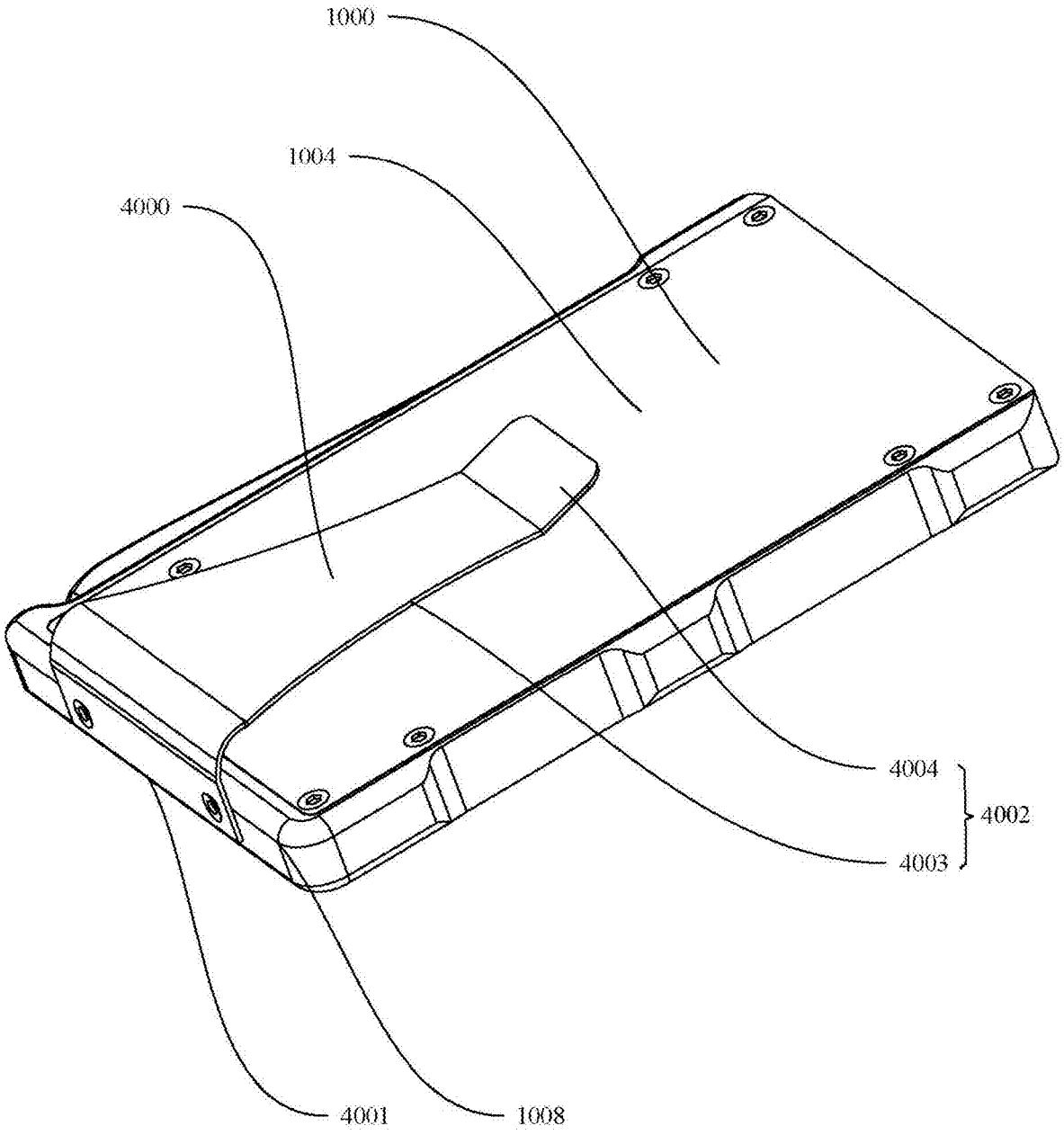
FIG. 9 is a schematic diagram of a structure of a fixing clamp.

In this embodiment, as shown in FIG. 9, the outer housing 1000 is also equipped with a fixing clamp 4000. The fixing clamp 4000 is configured for fixing the card box 100 to objects such as belts or straps, making it easy to carry or clamp personal information cards. Specifically, the fixing clamp 4000 includes a connecting wall 4001 and a clamping wall 4002 integrally formed with the connecting wall 4001. The connecting wall 4001 is detachably installed on the bottom wall 1008, and the clamping wall 4002 is used for clamping the card box 100 to an external device. The clamping wall 4002 includes an abutting plate 4003 obliquely arranged from outside to inside and a warping plate 4004 arranged from inside to outside. The warping plate 4004 is arranged at an end of the abutting plate 4003, and a connection between the warping plate 4004 and the abutting plate 4003 abuts against an outer surface of the first housing 1004 to provide stronger clamping force, effectively preventing the card box 100 from sliding or falling off during use, and improving the reliability of the device. When in use, the user can adjust the warping plate 4004 to press the abutting plate 4003 against items such as belts or straps. The connection between the warping plate 4004 and the abutting plate 4003 abuts against the outer surface of the card box 100, thereby firmly fixing the card box 100 to the belt or strap.

Figure 10:
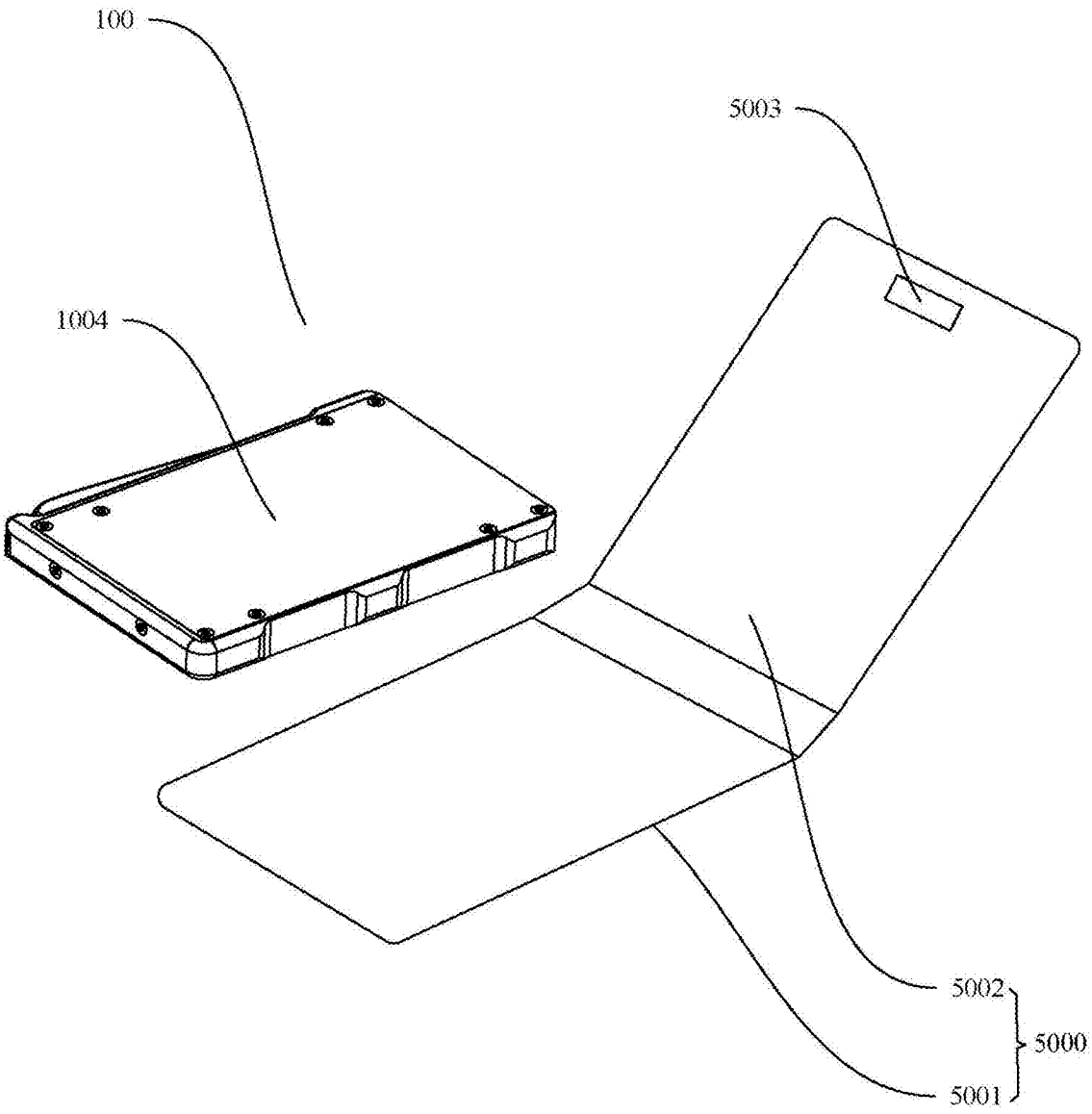
FIG. 10 is a schematic diagram of a structure of a protective cover.

In this embodiment, as shown in FIG. 10, the card box 100 further includes a protective cover 5000. The protective cover 5000 includes a first part 5001 and a second part 5002. The second part 5002 is capable of rotating relative to the first part 5001, and the first part 5001 is fixedly connected to an outer surface of the second housing 1005. The second part 5002 is capable of being folded and overlaid on the outer surface of the first housing 1004. The protective cover 5000 can effectively protect an external surface of the card box 100 to prevent scratches, wear and other external damage, thereby extending the service life of the card box. Moreover, the second part 5002 is capable of rotating relative to the first part 5001, and is capable of being folded and overlaid on the outer surface of the first housing 1004, so that the user can easily open and close the protective cover when the card box is needed, increasing the convenience of use.

In other embodiments, a transparent window is provided on the second part 5002. The transparent window allows the user to directly view the contents inside the card box 100 without opening the protective cover 5000, facilitating the user to quickly confirm the status and position of the cards.

In this embodiment, referring to FIG. 8 and FIG. 10, a magnetic attraction member 1205 is provided in the installation slot 1204, and a magnetic attraction part 5003 is provided on the second part 5002. The magnetic attraction member 1205 is capable of magnetically attracting with the magnetic attraction part 5003, so that the second part 5002 is always overlaid on the outer surface of the first housing 1004, and it is convenient for the user to open the card box 100 and extract the cards inside.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A press-grab type card box, comprising an outer housing, wherein an opening is defined in a top end of the outer housing, the outer housing is also provided with an accommodating cavity that is capable of accommodating an external card, and the opening is in communication with the accommodating cavity, so that the external card can be pushed into the accommodating cavity from the opening; and a pushing member is provided at a bottom portion of the accommodating cavity for holding at least one external card;

a friction member is provided on an inner surface of the outer housing for preventing the external card from slipping off;

the outer housing is also equipped with a triggering member, the triggering member abuts against the pushing member, and the triggering member is configured for moving between a first position and a second position; when the triggering member is in the first position, the external card is held in the accommodating cavity; and when the triggering member is in the second position, the triggering member is capable of driving the pushing member to push the external card at least partially out of the accommodating cavity;

wherein the outer housing comprises a first housing and a second housing connected to the first housing;

a first outer side wall, a second outer side wall, and a bottom wall are provided between the first housing and the second housing; the second outer side wall is opposite to the first outer side wall, the bottom wall is positioned between the first outer side wall and the second outer side wall, an installation hole is defined in the first outer side wall, and the triggering member is movably installed in the installation hole;

wherein the triggering member comprises a first end and a second end, the first end is rotationally connected to an inner portion of the outer housing through a rotating member, the second end comprises a transmission part, the transmission part abuts against the pushing member, and when the triggering member is pressed, the triggering member rotates around the rotating member, so that the transmission part drives the pushing member to move upward to push the external card out of the card box.

2. The press-grab type card box according to claim 1, wherein the card box is also internally equipped with an elastic member for restoring the pushing member, the elastic member is disposed below the pushing member, one end of the elastic member is fixedly connected to the pushing member, an opposite end of the elastic member is fixedly connected to an inner wall surface of the outer housing, and when the trigger member is released, the elastic member drives the pushing member to move downward to restore the pushing member.

3. The press-grab type card box according to claim 2, wherein a bottom portion of the outer housing is provided with an installation slot, the installation slot is positioned below the pushing member, the installation slot is equipped with an inclined surface on one side adjacent to the elastic member, the inclined surface has an identical inclination angle with the elastic member, and the inclined surface is used for reducing friction and resistance during a process of the elastic member driving the pushing member to be restored.

4. The press-grab type card box according to claim 3, wherein a through hole is defined in the pushing member, a fixing shaft is provided on the inner wall surface of the outer housing, one end of the elastic member is installed in the through hole, and an opposite end of the elastic member is fixedly connected to the fixing shaft.

5. The press-grab type card box according to claim 4, wherein the inner portion of the outer housing is provided with a concave platform on one side near the first outer side wall, a fixing hole is defined in the concave platform, the first end is provided with a connecting part, a connecting hole is defined in the connecting part, the rotating member passes through the connecting hole and extends to the fixing hole for fixation, so that the first end is capable of rotating around the rotating member.

6. The press-grab type card box according to claim 5, wherein a first position limiting block extends from a bottom edge of the concave platform, a second position limiting block is also provided on one side of the inner portion of the outer housing near the first outer side wall, the first position limiting block and the second position limiting block jointly define a moving slot, and the moving slot is configured for allowing the triggering member to move within the moving slot.

7. The press-grab type card box according to claim 6, wherein an installation column is provided between the first position limiting block and the second position limiting block, and the friction member is installed on the installation column to prevent the external card from falling into the card box again when pushed out of the card box.

8. The press-grab type card box according to claim 7, wherein the friction member is configured as a silicone block, and one side of the friction member near the inner portion of the outer housing is also provided with a plurality of friction protrusions for preventing the external card from falling into the card box again when pushed out of the card box.

9. A press-grab type card box, comprising an outer housing;

wherein an opening is defined in a top end of the outer housing, the outer housing is also provided with an accommodating cavity that is capable of accommodating an external card, and the opening is in communication with the accommodating cavity, so that the external card can be pushed into the accommodating cavity from the opening; and a pushing member is provided at a bottom portion of the accommodating cavity for holding at least one external card;

a friction member is provided on an inner surface of the outer housing for preventing the external card from slipping off;

the outer housing is also equipped with a triggering member, the triggering member abuts against the pushing member, and the triggering member is configured for moving between a first position and a second position; when the triggering member is in the first position, the external card is held in the accommodating cavity; and when the triggering member is in the second position, the triggering member is capable of driving the pushing member to push the external card at least partially out of the accommodating cavity;

wherein the friction member is configured as a cotton cloth, a surface of the cotton cloth is provided with a raised transverse bar, the raised transverse bar is used for providing a greater friction force, the friction member is bonded to the inner wall surface of the outer housing, and a coverage area of the friction member is not less than 0.9% of an surface area of the inner wall surface of the outer housing.

10. The press-grab type card box according to claim 8, wherein a receiving part is provided at a junction of the first outer side wall and the bottom wall, the receiving part is provided with a receiving slot for receiving the transmission part, and the receiving slot is in communication with the installation hole, so that the transmission part can pass through the installation hole and be movably installed in the receiving slot.

11. The press-grab type card box according to claim 10, wherein a bottom portion of the transmission part is provided with a buckle, and the buckle abuts against the receiving part, so that when the triggering member moves to the first position, the transmission part is positioned at the inner portion of the outer housing.

12. The press-grab type card box according to claim 11, wherein the pushing member is transversely installed at the bottom portion of the outer housing, the pushing member is configured as a metal pushing member, one end of the pushing member is rotationally connected to the inner wall surface of the outer housing, an opposite end of the pushing member is provided with a plurality of steps, and the steps are used for placing cards inside the accommodating cavity in a staggered manner.

13. The press-grab type card box according to claim 12, wherein the pushing member comprises a rotating end and a movable end, the rotating end is provided with a rotating hole, the inner wall surface of the outer housing is provided with a shaft column, and the shaft column is inserted into the rotating hole, so that the pushing member is capable of rotating around the shaft column; and when the triggering member moves to the second position, the transmission part is capable of driving the pushing member to rotate around the shaft column, so that the opposite end of the pushing member moves upward to push the external card at least partially out of the card box.

14. The press-grab type card box according to claim 13, wherein the steps are positioned at the movable end and are oriented towards an inner wall surface of the second housing, heights of the steps increase sequentially in a direction from the movable end towards the rotating end, and each of the steps is configured for receiving one external card.

15. The press-grab type card box according to claim 14, wherein the outer housing is also equipped with a fixing clamp for fixing the card box to objects such as belts or straps, the fixing clamp comprises a connecting wall and a clamping wall integrally formed with the connecting wall, the connecting wall is detachably installed on the bottom wall, and the clamping wall is used for clamping the card box to an external device.

16. The press-grab type card box according to claim 15, wherein the clamping wall comprises an abutting plate obliquely arranged from outside to inside and a warping plate arranged from inside to outside, the warping plate is arranged at an end of the abutting plate, and a connection between the warping plate and the abutting plate abuts against an outer surface of the first housing, so that the card box is clamped with objects such as belts or straps.

17. The press-grab type card box according to claim 3, wherein the card box further comprises a protective cover, the protective cover comprises a first part and a second part, the second part is capable of rotating relative to the first part, the first part is fixedly connected to an outer surface of the second housing, and the second part is capable of being folded and overlaid on the outer surface of the first housing.

18. The press-grab type card box according to claim 17, wherein a magnetic attraction member is provided in the installation slot, a magnetic attraction part is provided on the second part, and the magnetic attraction member is capable of magnetically attracting with the magnetic attraction part, so that the second part is always overlaid on the outer surface of the first housing.

19. The press-grab type card box according to claim 9, wherein the outer housing comprises a first housing and a second housing connected to the first housing; a first outer side wall, a second outer side wall, and a bottom wall are provided between the first housing and the second housing; the second outer side wall is opposite to the first outer side wall, the bottom wall is positioned between the first outer side wall and the second outer side wall, an installation hole is defined in the first outer side wall, and the triggering member is movably installed in the installation hole.

20. The press-grab type card box according to claim 19, wherein the triggering member comprises a first end and a second end, the first end is rotationally connected to an inner portion of the outer housing through a rotating member, the second end comprises a transmission part, the transmission part abuts against the pushing member, and when the triggering member is pressed, the triggering member rotates around the rotating member, so that the transmission part drives the pushing member to move upward to push the external card out of the card box.

* * * * *